United States Patent [19]

Arnoux et al.

[11] 4,309,682

[45] Jan. 5, 1982

[54] CONNECTIONS BETWEEN A MOTOR ASSEMBLY AND A CONTACT UNIT BASE OF AN ELECTROMAGNETIC RELAY

[75] Inventors: Daniel Arnoux, St.-Germain-en-Laye; Claude Genter; Jean Aguettaz, both of Paris; Alain Berthelot, Conches; Bernard Michel, Conflans-Ste. Honorine, all of France

[73] Assignee: Relais Signalisation Automatisme, Societe Anonyme, Paris, France

[21] Appl. No.: 160,476

[22] Filed: Jun. 18, 1980

[30] Foreign Application Priority Data

Jun. 19, 1979 [FR] France ..... 79 15643

[51] Int. Cl.[3] ..... H01H 50/04

[52] U.S. Cl. ..... 335/128; 335/135; 335/202

[58] Field of Search ..... 335/128, 135, 202, 115, 335/125, 281, 282, 127

[56] References Cited

U.S. PATENT DOCUMENTS

| | | | |
|---|---|---|---|
| 2,945,106 | 7/1960 | Moyer | 335/135 |
| 4,101,856 | 7/1978 | Durr | 335/135 |
| 4,193,052 | 3/1980 | Hayden | 335/128 |

FOREIGN PATENT DOCUMENTS 1124611 10/1956 France .

*Primary Examiner*—Harold Broome

[57] ABSTRACT

An electromagnetic relay comprising a base of insulating material carrying stationary and movable contacts and output lugs, and a motor assembly, the latter comprising a right-angled yoke, a core with its coil, crimped to the inner face of a first one of the two flanges of the right-angled yoke, and an armature pivotally mounted to the free end of the second flange of said yoke and having bent arms operable to actuate the movable contacts when the base is fixed to the outer face the second flange and the coil is energized. The coil has a spool or frame with at least one end flange provided with metal tongues for coil connection extending towards the base and passing through apertures in the second flange of the yoke, said tongues resiliently engaging inner ends of associated ones of said output lugs.

5 Claims, 2 Drawing Figures

CONNECTIONS BETWEEN A MOTOR ASSEMBLY AND A CONTACT UNIT BASE OF AN ELECTROMAGNETIC RELAY

BACKGROUND OF THE INVENTION

The present invention relates to an electromagnetic relay comprising a motor assembly, a contact unit and means for attaching together said contact unit and said motor assembly, said contact unit comprising a base of insulating material provided with stationary and movable contacts and with output lugs connected to said stationary and movable contacts, respectively, and with further output luds, said motor assembly comprising a yoke having two flanges at right angles to each other, a core fixed to the inner face of a first one of said two flanges of said yoke, a coil mounted on said core and having a spool or frame with at least one end flange provided with electrically conducting metal tongues to which the ends of the coil wire are enchored, and a movable armature pivotally mounted to the free end of a second one of said two flanges to said yoke and having bent arms, said base of insulating material being fixed through said attaching means to the outer face of the second flange of said yoke, and said bent arms being operable to actuate said movable contacts when said coil is energized.

A relay of this type is described for example in French Pat. No. 1 527 178. In this known relay, the electric connections between the ends of the coil wire and said further output lugs are provided by two flexible lead-wires. To effect these electric connections, it is preferable for the metal tongues to be fixed into said end flangle of the frame of the coil so that the ends of the coil wire may be anchored to said tongues as described for example in French Pat. No. 2 291 590. These connections require soldering operations which are long and costly, and which cannot be very easily automated. There is also a risk that particles of resin coming from the core flux of a tin soldes wire are projected onto said stationary and movable contacts during the soldering operations. When multistrand wires are used as said flexible lead-wires, some strands of said multistrand wires may also not be caught in the solder joints and decrease the insulation.

Furthermore, the inner ends of said further output lugs for connecting the coil must be readily accessible when the base has been fixed to the yoke, so as to allow the soldering operations. This leads to placing the output lugs for the coil in an outer row of lugs, for example at the side of the base adjacent to the armature of the relay. Now it may desirable on the contrary to place the output lugs for the coil in an inner row of lugs, so as to allow the greatest possible length for the flexible metal strips which carry the movable contacts of the change-over contacts of the relay.

Finally, it is desirable for the motor assembly to be easily attached to, and possibly detached from the base of the contact unit, so as to simplify manufacture and maintenance. The actuation of the movable contacts by bent arms of the armature facilitates this coupling, but there remains the obstacle caused by the flexible lead-wires for connecting the coil.

SUMMARY OF THE INVENTION

Accordingly, the object of the present invention is to provide an improved connection between the motor assembly and the contact unit of the relay of the above type and more particularly an improved connection between the coil of the motor assembly and the corresponding output lugs of the contact unit, which does not present the disadvantages mentioned above.

According to the invention, the metal tongues of the end flange of the frame of the coil are situated on the side of said end flange facing the second flange of the yoke, said tongues extending towards the base beyond the second flange of the yoke and being resiliently engageable with the inner end of said further lugs for making electrical contact therewith when assembling together the motor assembly and the base of the contact unit.

Other objects, features and advantages of the present invention will become more apparent in the following description, given by way of non-limiting example, with reference to the accompanying drawings, in which:

DESCRIPTION OF THE PREFERRED EMBODIMENT

Figure 1:
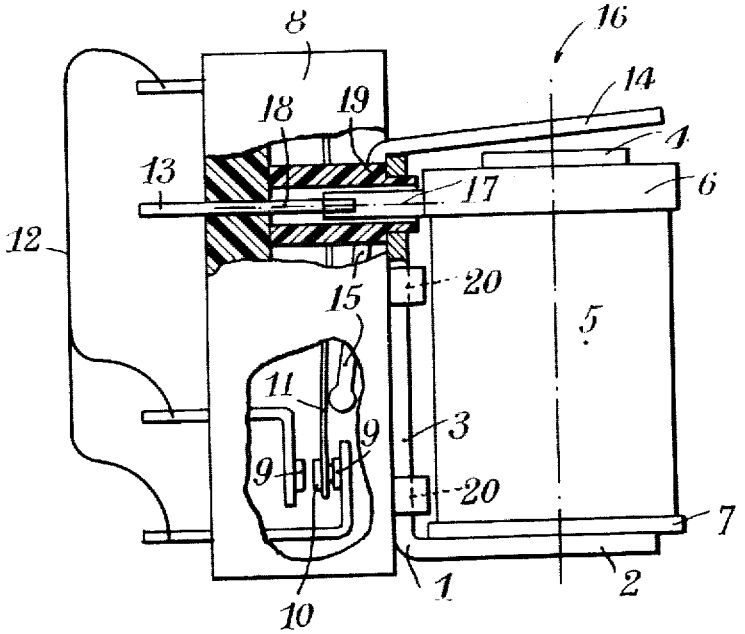
FIG. 1 is a side view of the relay of the invention, with parts broken away to better show the connection between a tongue and an output lug and one set of contacts of a change-over contact of the relay.

In FIG. 1, reference number 1 indicates a right-angled yoke comprising a first flange 2 and a second flange 3. On the inner face of the first flange 2 is crimped a core 4. The core 4 carries a coil 5 wound on a spool or frame having two end flanges 6 and 7.

On the outer face of the second flange 3 of yoke 1 is fixed a base 8 of insulating material provided with stationary contacts 9 and movable contacts 10. In the case of change-over contacts, the movable contacts 10 are for example carried by flexible movable strips 11, respectively. The stationary and movable contacts 9, 10 are connected to output lugs 12 which extend at right angles to the second flange 3.

The base 8 also has output lugs 13 for the connections of coil 5.

The free end of the second flange 3 serves as a pivot for a movable armature 14 which is drawn against the free end of core 4 when the coil 5 is energized.

The armature 14 has a number of bent arms 15 one of which is visible in FIG. 1 corresponding to the number of flexible strips 11. Each arm 15 has an insulated end in engagement with a respective one of the flexible strips 11 for actuating the same when the coil 5 is energized.

Thus, the relay shown in FIG. 1 comprises a contact unit including the base 8, the output lugs 12 and 13 and the contacts 9, 10 with the flexible strips 11, and a motor assembly 16 including the right-anged yoke 1, core 4, coil 5 and armature 14.

Figure 2:
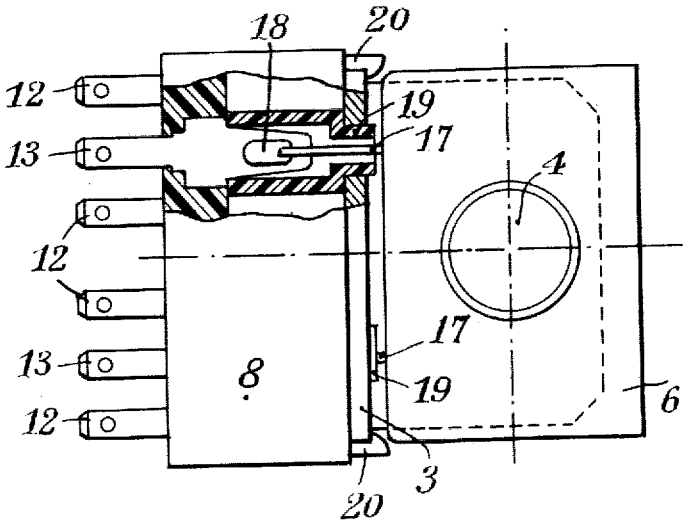
FIG. 2 is a front view of the relay, with the armature withdrawn and with parts broken away to show the above-mentioned connection.

The elements 3, 4, 6, 8, 12 and 13 are also shown in FIG. 2, in which the armature 14 has been removed.

In FIGS. 1 and 2, it can be seen that two metal tongues 17 are fixed into the end flange 6 of the coil frame, on the armature side. Said tongues 17 are used for anchoring the ends of the coil wire of coil 5, as described in French Pat. No. 2 291 590. Said ends may for example be automatically soldered after the coiling operation.

The tongues 17 are situated on the side of end flange 6 which faces the second flange 3 of the yoke, and they extend towards the base 8 beyond said second flange 3. Said tongues 17 are each adapted to come resiliently into electrical contact with an inner end of an output lug 13 of base 8 when motor assembly 16 is presented and assembled to the base 8.

More precisely, as shown in FIG. 2, the free end of each tongue 17 has a flat rectangular shape and is force-fitted into the lyre-shaped inner end 18 of the associated lug 13.

Preferably, lug 13 is also flat and has an axis of symmetry which is common with that of the associated tongue 17. Lug 13 and tongue 17 are situated in perpendicular planes.

In FIGS. 1 and 2, it can also be seen that the second flange 3 of the yoke 1 is provided with apertures at the places where tongues 17 pass therethrough, and that insulating sleeves 19 extending from base 8 penetrate into said apertures so as to ensure good insulation between tongues 17 and yoke 1.

It can be seen that the output lugs 13 are parallel to the output lugs 12 and are situated in an inner row, and not in an outer row of the rectangular array or matrix formed by the output lugs. Thus, the movable strips 11 may be connected to the lugs 12 of an end row of lugs and may have the greatest possible length inside the base 8.

With this arrangement, in order that the resilient connection between tongues 17 and lug 13 does not interfere with the movable strips 11, it can be seen in FIG. 2 that each lug 13 is disposed between two columns of lugs 12 of the array, each column of lugs being associated with the two stationary contacts 9 and one movable contact 10 of a change-over contact. The relay shown in FIG. 2 has four change-over contacts.

To facilitate the assembling and possibly disassembling of base 8 from motor assembly 16, the edge of the base 8 adjacent the yoke 1 is provided with catches 20 adapted to resiliently clip themselves onto the edges of the second flange 3 of the yoke when the motor assembly 16 is presented on the base 8.

Of course, many modifications may be made to the above-described embodiment without departing from the scope and spirit of the invention.

Thus, by way of example, tongues 17 could have been positioned on the end flange 7 adjacent the first flange 2 of the yoke 1, or each tongue 17 could have been positioned on a respective one of the two end flanges 6 and 7.

Tongues 17 or the inner portion of lugs 13 could be bent so that end flange 6 may not necessarily be in alignment with the row of output lugs 13.

Or else, lugs 13 could be offset, bent or shaped so as to be aligned with a column of lugs 12 of a change-over contact.

Moreover, in the case of a two change-over contact relay, the output lugs could also have been shifted to the sides, in a plane parallel to that of the second flange 3.

What is claimed is:

1. In an electromagnetic relay comprising a motor assembly, a contact unit and means for attaching together said contact unit and said motor assembly, said contact unit comprising a base of insulating material provided with stationary and movable contacts and with output lugs connected to said stationary and movable contacts, respectively, and with further output lugs, said motor assembly comprising a yoke having two flanges at right angles to each other, a core fixed to the inner face of a first one of said two flanges of said yoke, a coil mounted on said core and having a spool or frame with at least one end flange provided with electrically conducting metal tongues to which the ends of the coil wire are anchored, and a movable armature pivotally mounted to the free end of a second one of said two flanges of said yoke and having bent arms, said base of insulating material being fixed through said attaching means to the outer face of the second flange of said yoke, and said bent arms being operable to actuate said movable contacts when said coil is energized, the improvement consisting in that the metal tongues of the end flange of the frame of the coil are situated on the side of said end flange facing the second flange of the yoke, said tongues extending towards the base beyond said second flange of the yoke and being resiliently engageable with the inner end of said further lugs for making electric contact therewith when assembling together the motor assembly and the base of the contact unit.

2. A relay as claimed in claim 1, wherein the inner end of each of said further lugs have the shape of a lyre, into which a respective one of said tongues may be force-fitted.

3. A relay as claimed in claim 2, wherein said further lugs with their lyre-shaped inner ends are flat and each have an axis of symmetry which is common with that of the associated tongue.

4. A relay as claimed in claim 1, wherein the second flange of the yoke is provided with apertures through which pass the tongues, and insulating sleeves extending from the base penetrate into said apertures.

5. A relay as claimed in claim 1, wherein the base is provided with catches adapted to clip themselves resiliently on the edges of the second flange of the yoke when the motor assembly of the relay is presented on the base.

* * * * *